United States Patent [19]

Malsbury et al.

[11] 4,310,266

[45] Jan. 12, 1982

[54] FRICTION ROCK STABILIZER AND METHOD OF INSERTING SAME IN AN EARTH STRUCTURE BORE

[75] Inventors: Richard G. Malsbury, Ringoes; Wallace A. McGahan, Lawrenceville, both of N.J.

[73] Assignee: Ingersoll-Rand Company, Woodcliff Lake, N.J.

[21] Appl. No.: 129,039

[22] Filed: Mar. 10, 1980

[51] Int. Cl.[3] ..... E21D 21/00; E21D 20/00

[52] U.S. Cl. ..... 405/259; 411/60

[58] Field of Search ..... 405/259, 260, 261; 411/15, 44, 60, 57-59, 61-63

[56] References Cited

U.S. PATENT DOCUMENTS

| | | | |
|---|---|---|---|
| 1,810,749 | 6/1931 | Bowler | 411/15 |
| 2,690,693 | 10/1954 | Campbell | 405/259 X |
| 4,012,913 | 3/1977 | Scott | 405/259 X |
| 4,260,294 | 4/1981 | Cantrel | 405/259 |

*Primary Examiner*—Dennis L. Taylor

*Attorney, Agent, or Firm*—David W. Tibbott; Bernard J. Murphy

[57] ABSTRACT

According to an embodiment thereof, the stabilizer has a generally axially-extending lip projecting therefrom for engagement (of the latter) by a powered, rotary, thrusting apparatus. The method, then, comprises forceably thrusting a stabilizer into an earth structure bore and rotating the stabilizer during the thrusting thereof, particularly with the aid of apparatus of the aforesaid type.

6 Claims, 7 Drawing Figures

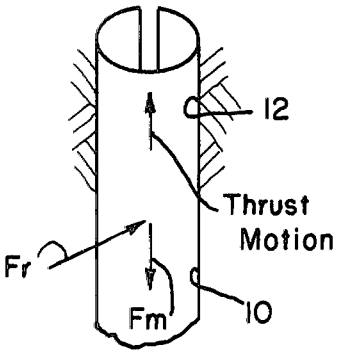
FIG. 1
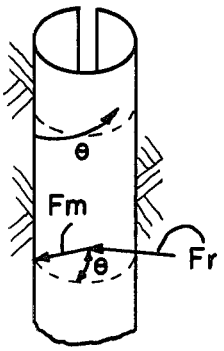
FIG. 2
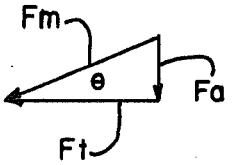
FIG. 2A
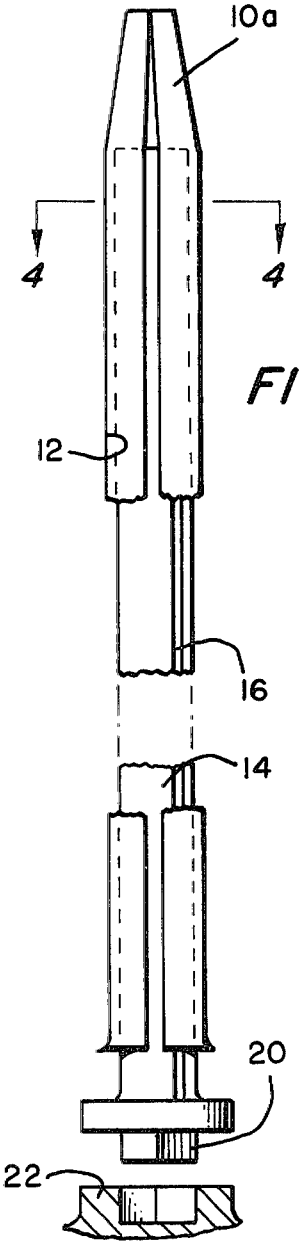
FIG. 3
FIG. 4
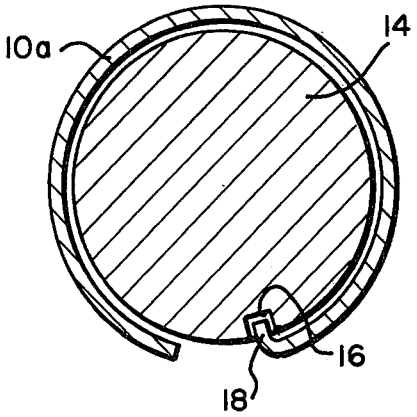

FRICTION ROCK STABILIZER AND METHOD OF INSERTING SAME IN AN EARTH STRUCTURE BORE

This invention pertains to friction rock stabilizers, for insertion into earth structure bores (for stabilizing the earth structure), and to methods of inserting the same, and in particular to inserting methods which require significantly reduced axially-directed thrusting force vis-a-vis prior art methods, and to novel friction rock stabilizers especially adapted to accommodate the inventive inserting methods.

Stabilizers of the type comprehended by this disclosure are exemplified by U.S. Pat. No. 3,922,867, issued on 2 Dec. 1975, to James J. Scott, for "Friction Rock Stabilizers". Typically, to insure that there shall obtain sufficient frictional engagement between the wall of the earth structure bore and the stabilizer, the bore is made of a smaller dimension than the free, unrestrained transverse dimension of the stabilizer to be inserted therein. Stabilizer insertion, then, requires considerable axially-directed thrust force. The final anchoring force achieved for an inserted stabilizer is determined, generally, from the relative dimensions of the bore and stabilizer, and the force exerted to fix the latter in place. Commonly, the thrust force available from state-of-the-art mine roof bolter equipments is less than that which will accomplish stabilizer insertion to yield an acceptable anchoring force.

It is an object of this invention to provide a friction rock stabilizer, and a method of friction rock stabilizer insertion, which enable insertion with considerably lower insertion force and realize an acceptable, final, achieved anchoring force.

It is an object of this invention, particularly, to set forth a method of inserting an elongate, substantially tubular, friction rock stabilizer into an undersized bore formed in an earth structure, to stabilize the structure, comprising the steps of forceably thrusting the stabilizer axially into the bore; and rotating the stabilizer during at least a portion of the thrusting step.

It is further an object of this invention to disclose an elongate, substantially tubular, friction rock stabilizer for insertion into an undersized bore formed in an earth structure to stabilize the structure, comprising means projecting from a surface of the stabilizer defining a prominent, substantially right-angular lip for engagement thereof by a powered, rotary, thrusting means.

Further objects of this invention, as well as the novel features thereof, will become more apparent by reference to the following description, taken in conjunction with the accompanying figures, in which:

FIG. 1 is a simple, perspective line drawing of a friction rock stabilizer relative to which forces operative therewith are depicted;

FIG. 2 is a line drawing similar to that of FIG. 1, in which the forces operative with a stabilizer, according to the inventive teachings, are depicted;

FIG. 3 is a discontinuous, elevational view of an embodiment of the novel stabilizer, shown in operative association with a mandrel and inserting apparatus;

FIG. 4 is a cross-sectional view, taken along section 4—4 of FIG. 3, in greatly enlarged scale (relative to FIG. 3);

Figure 5:
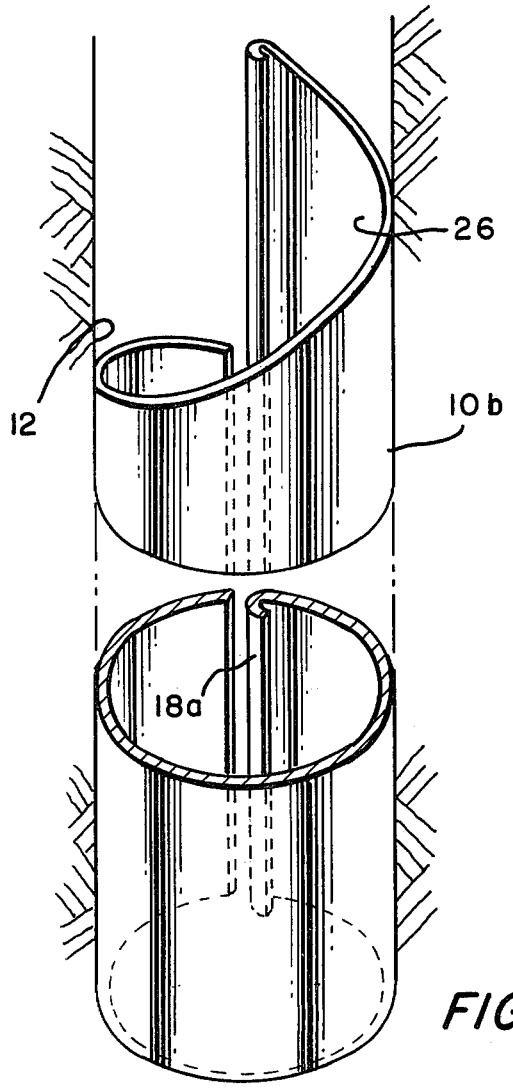
FIG. 5 is a discontinuous, perspective view of an alternative embodiment of the novel stabilizer.

To reduce the axial force required to install a friction rock stabilizer 10, it is a teaching of this invention to rotate the stabilizer at the same time as it is being inserted into an undersized earth structure bore. The result of this rotation will be to reduce the required axial force needed for installation, but will not affect the final anchoring force that the installed stabilizer 10 will achieve.

It is a practical observation that a person can pull out with a pair of pliers a nail which is imbedded in a board if he rotates the nail at the same time as he pulls. However, the same pulling force will not budge the nail unless rotation is imparted at the same time. This principle is utilized in the present invention. The principle states that the direction of force which resists the motion is opposite of the direction of the motion. Thus, when the motion is helical, the axial component of the force required to produce motion is reduced in proportion to the tangent of the helical angle of the motion. This can be understood by referring to FIG. 1. Although the outward radial forces against the surface of the earth structure bore 12 are exerted by the stabilizer 10 all along its length and around its circumference, for purposes of simplified explanation let us suppose that all of these radial forces can be represented by a single radial force $F_r$ shown in FIG. 1. If the stabilizer 10 is thrust straight into the bore 12 without rotation, the resisting frictional force $F_m$ will act in a direction opposite to the thrust motion. The value of $F_m$ is determined by the value of $F_r$ and the associated friction coefficient between the stabilizer and the bore wall. Now, if the stabilizer 10 is simultaneously thrust in and rotated, as represented in FIG. 2, with a helical angle of motion $\theta$, then the value of the resisting force will be $F_m$ as before, but the direction of the resisting force will be again in an opposite direction to the motion, or inclined at an angle $\theta$ to the circumferential direction. As shown in the vector triangle, this resisting force $F_m$ now has circumferential component $F_t$ and axial component $F_a$. It is the significantly reduced axial component $F_a$ which the upward thrust of the insertion apparatus must overcome. The circumferential force $F_t$ is readily met by the torque of the apparatus (i.e., the same having a gear box which rotates a chuck to effect rotation of the stabilizer 10).

It has been concluded that rotation of the stabilizer 10 by simply grabbing hold, locally, of one very terminal end, and twisting while pushing into the bore, will not work because the stabilizer 10*a* will twist and bind in the bore. By changing the design of the stabilizer 10*a*, as shown in FIGS. 3 and 4, a mandrel 14 can be inserted which will engage over substantially the full length of the stabilizer. A slot 16 in the mandrel 14 engages an inwardly projecting lip 18 formed on an edge of the stabilizer 10*a* and provides a means to rotate the stabilizer by engaging it along its length.

The novel method comprises executing rotation of the stabilizer 10*a* through a range comprising: less than a full rotation for each one inch (25.40 mm), approximately, of axial travel into the bore 12, to more than a full rotation for each one foot (0.3048 m), approximately, of axial travel thereof into the bore 12.

The only adaption required of existing roof bolters is to incorporate therein a rotary gear box with a higher torque motor to provide a necessary rotation torque during insertion. Further, the mandrel 14 requires an engageable drive end 20 for engaging the gear box chuck 22.

Figure 6:
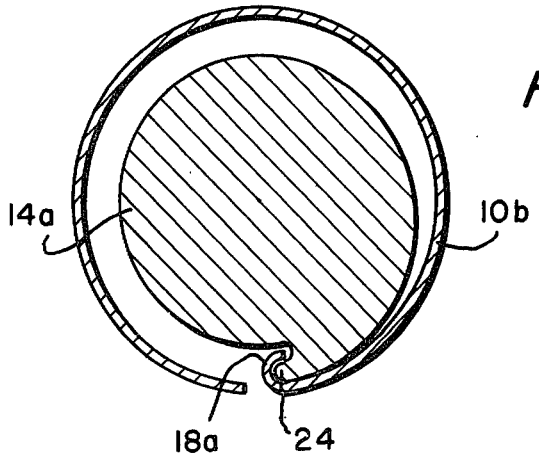
FIG. 6 is a cross-sectional view of the stabilizer embodiment of FIG. 5, and of a mandrel therefor.

The alternative embodiment 10*b* of the novel friction rock stabilizer shown in FIGS. 5 and 6 is similar to that of FIGS. 3 and 4, except that the mandrel-engaging lip 18*a* is more fully turned. A slightly modified mandrel 14*a*, having a substantially tangential limb 24, is used to engage lip 18*a*. By contacting the turned or folded lip 18*a*, as shown, by the mandrel 14*a*, the stabilizer 10*b* will have a reduced loading against the wall of the bore 12. The stabilizer will tend to wrap around the mandrel, minimizing any likelihood of the stabilizer jamming in the bore 12. Additionally, the leading end 26 of the stabilizer 10*b* is spirally formed, after the configuration of a corkscrew, generally, except that the spiral form is of substantially uniform diameter. This spiral-form end 26 greatly facilitates accession of, or entry into, the bore 12.

While we have described our invention in connection with specific embodiments thereof, it is to be clearly understood that this is done only by way of example and not as a limitation to the scope of our invention as set forth in the objects thereof and in the appended claims.

We claim:

1. A method of inserting an elongate, substantially tubular, friction rock stabilizer, which has a pair of substantially parallel, axially-extended and substantially linear edges along a substantial length thereof, into an undersized bore formed in an earth structure, to stabilize the structure, comprising the steps of:

forceably thrusting the stabilizer axially into the bore; and rotating the stabilizer during at least a portion of the thrusting step; wherein said rotating step comprises engaging only one of said edges with a tool, such as a mandrel or the like, and driving the one edge in rotation by rotating the engaged tool.

2. A method, according to claim 1, wherein:

said rotating step comprises rotating the stabilizer through less than three hundred and sixty degrees of arc for each approximately one inch (25.40 mm.) of axial travel thereof into the bore.

3. A method, according to claim 1, wherein:

said rotating step comprises rotating the stabilizer through more than three hundred and sixty degrees of arc for each approximately one foot (0.3048 m.) of axial travel thereof into the bore.

4. A method, according to claim 1, wherein:

said thrusting and rotating steps comprise engaging at least said one edge of the stabilizer with a tool, as aforesaid, which comprises a powered, rotary, thrusting device.

5. An elongate, substantially tubular, friction rock stabilizer for insertion into an undersized bore formed in an earth structure to stabilize the structure, comprising:

means projecting from a surface of the stabilizer defining a prominent, substantially right-angular lip for engagement thereof by a powered, rotary, thrusting means; wherein said stabilizer has a substantially axially-directed, linear, through-going slot formed therein along a substantial length thereof;

said slot defines a pair of substantially parallel edges;

only one of said edges projects inwardly of the stabilizer; and said one edge defines said lip.

6. A friction rock stabilizer, according to claim 5, wherein:

a terminal end of the stabilizer is formed in a spiral configuration with a substantially uniform radius, relative to an axial centerline of the stabilizer, throughout the configuration.

* * * * *